US005574795A

United States Patent [19]

Seki

[11] Patent Number: 5,574,795

[45] Date of Patent: Nov. 12, 1996

[54] HEADPHONE APPARATUS

[75] Inventor: Hideki Seki, Tokyo, Japan

[73] Assignee: Sony Corporation, Japan

[21] Appl. No.: 281,113

[22] Filed: Jul. 27, 1994

[30] Foreign Application Priority Data

Jul. 31, 1993 [JP] Japan ..... 5-208470

[51] Int. Cl.[6] ..... H04R 25/00

[52] U.S. Cl. ..... 381/183; 381/187

[58] Field of Search ..... 381/183, 187, 381/188, 205, 25; 379/430; 181/128, 129

[56] References Cited

U.S. PATENT DOCUMENTS 3,919,501 11/1975 Cech et al. ..... 381/183

5,018,599 5/1991 Dohi et al. ..... 181/129

5,406,037 4/1995 Nageno et al. ..... 381/187

*Primary Examiner*—Curtis Kuntz

*Assistant Examiner*—Huyen D. Le

*Attorney, Agent, or Firm*—Ronald P. Kananen

[57] ABSTRACT

A headphone apparatus includes a head band, a pair of headphone units and a suspender member. The head band is formed in a substantially U-shape by a member exhibiting pre-set toughness. A headphone unit is provided at each side of the head band. A suspender member mounted across both ends of the head band at a position above a location of attachment of the head band to said headphone unit. The suspender member is deformed along the contour of the head when the headphone apparatus is mounted on the head. The suspender member has a non-extendable section and an extendable section unified to the non-extendable section and extended and contracted along the length of the suspender member.

14 Claims, 8 Drawing Sheets

HEADPHONE APPARATUS

BACKGROUND

1. Field of the Invention

The present invention relates to a headphone apparatus. More particularly, the present invention relates to a headphone apparatus having a suspender member which is deformed along the shape of a user's head when the headphone is fitted thereon.

2. Background of the Invention

There has hitherto been proposed a headphone apparatus having unit sections each containing one of a pair of speaker units and interconnected by a connector bridge which is bent substantially arcuately to form a head band. The headphone apparatus is fitted with the connector bridge set on the user's head and with the speaker units set on the user's pinnas. When the headphone apparatus is set in this manner, the speaker units are positioned facing the pinnas.

In a certain version of the above-described headphone apparatus, the distance between the center of the connector bridge and the speaker units is adjustable in order to accommodate the distance from the scalp to the pinnas which is variable from user to user. This version of the headphone apparatus is designed so that the unit sections are movable along the connector bridge with respect thereto.

In another version of the headphone apparatus, such adjustment of the distance between the scalp and the pinnas may be achieved automatically. This version of the headphone apparatus includes a belt-shaped member 103 contained in a connector bridge 101 and a head pad 102 mounted on the belt-shaped member 103, as disclosed in, for example, the U.S. Pat. No. 5,018,599 and as shown herein in FIG. 1.

The headphone apparatus includes a pair of housings 1, 2 each containing a speaker unit and a connector bridge 101 interconnecting the housings 1 and 2. Both end portions of the connector bridge 101 are connected to the housings 1 and 2 by a holder 6 and a supporting arm 5. The connector bridge 101 is hollow and has slits 104 in the inner surface of the end portions thereof facing the user's head for communication with the hollow interior of the connector bridge. The belt-shaped member 103 is a looped member including a mid spring section contained within the bridge 101 and non-extendable sections of a non-extendable material, such as cloth, connected to both ends of the spring section. The belt-shaped member 103 has its spring section and its near-by section disposed within the hollow interior of the connector bridge 101 and has its non-extendable sections pulled out of the connector bridge 101 via the slits 104. The head pad 102 is formed of a flexible material, such as synthetic resin or rubber, and has the shape of an elongated ring or toroidal member. The head pad 102 has its both ends mounted on both ends of the belt-shaped member 103. The head pad 102 is mounted on the belt-shaped member 103 for constituting a toroidal member along with the belt-shaped member 103.

As the head pad is thrust against the user's head, the belt-shaped member 103 is pulled out of the connector bridge 101, with the head pad thrusting the head from above under the elastic recoiling force of the spring section. With the head pad 102 thrusting the scalp of the user's head, the housings 1, 2 are supported at the positions facing the pinnas. Thus it is possible with the present headphone apparatus to cope with the variable distance between the scalp and the pinnas of the individual users without changing the relative disposition of the housings 1, 2 and the connector bridge 101.

The above-described headphone apparatus having the belt-shaped member 103 and designed to cope with the variable distance between the scalp and the pinnas of the individual users automatically is complex in mechanical construction and has a large number of component parts. In addition, since it is necessary to have the belt-shaped member contained within the interior of the connector bridge, the assembling operation is necessarily complex. Besides, it is difficult to reduce the weight of the headphone apparatus shown in FIG. 1 because of the complex structure. Furthermore, the connector bridge 101 cannot be reduced in width because of limitations imposed on the shape and the structure of the connector bridge 101.

SUMMARY OF THE INVENTION

It is therefore an object of the present invention to provide a headphone apparatus which resolves the above-mentioned problems.

According to the present invention, there is provided a headphone apparatus including a head band formed in a bent shape, a headphone unit provided on each side of the head band, and a suspender member mounted across both ends of the head band at a position above a location of attachment of the head band to the headphone unit. The suspender member is deformed along the contour of the head when the headphone apparatus is mounted on the head. The suspender member has a non-extendable section and an extendable section unified to the non-extendable section and extended and contracted along the length of the suspender member.

According to the present invention, there is also provided a headphone apparatus including a head band formed in a bent shape of a material exhibiting pre-set tenacity, a pair of supports provided at both ends of the head band, a pair of headphone units mounted at free ends of the supports, and a belt-shaped member mounted across both ends of the head band at a position above a location of attachment of the head band to the headphone unit. The belt-shaped member has its both ends mounted at the proximal ends of each of the supports. The suspender member is deformed along the contour of the head when the headphone apparatus is mounted on the head. The suspender member has a non-extendable section and an extendable section unified to the non-extendable section. The extendable section is extended and contracted along the length of the suspender member.

According to the present invention, the suspender member composed of the extendable section and the non-extendable section is provided across both ends of an arcuately bent head band elastically thrusts the user's head during attachment of the headphone so that the headphone units may be maintained in the vicinity of the user's pinnas. The suspender member is constituted by the extendable and non-extendable sections unified to each other for simplifying the construction of the headphone apparatus. The present invention provides a headphone apparatus which, while having the function of accommodating variable distances between the scalp and the pinnas of individual users, is simplified in construction and facilitated in assembling operations.

BRIEF DESCRIPTION OF THE DRAWINGS

The present invention will be more readily understood with reference to the accompanying drawings, wherein.

DESCRIPTION OF THE INVENTION

Figure 1:
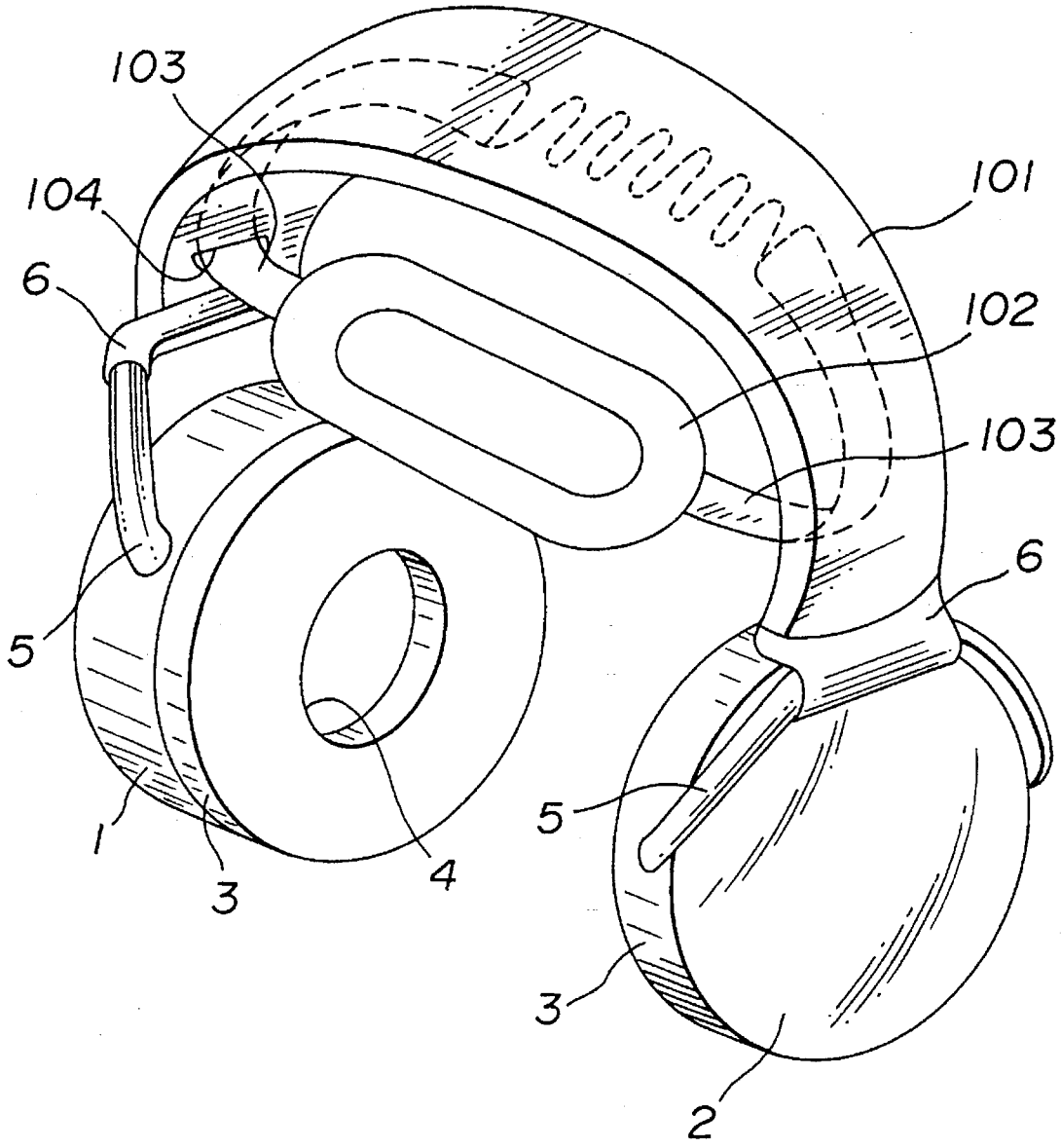
FIG.1 (PRIOR ART)
FIG. 1 is a perspective view showing the construction of a headphone apparatus from which the present invention has been made.

Referring to the drawings, preferred embodiments of the headphone apparatus according to the present invention will be explained in detail.

The headphone apparatus according to the first embodiment is now explained.

The headphone apparatus according to the first embodiment of the present invention has a pair of housing sections 1 and 2. Each of the housing sections is of a hemispherical or cup shape, such as one produced on cutting a hollow sphere. A speaker unit, not shown, is mounted within each of the housing sections 1 and 2. These speaker units are contained within the housing sections 1 an 2 with their sound radiating sides directed towards the open sides of the housing sections 1 and 2. Toroidally-shaped ear pads 3, 3 are fitted around the perimeter of the housing sections 1 and 2. These ear pads 3, 3 are formed of pliable materials, such as urethane.

The housing sections 1, 2 are mounted on both ends of the connector bridges 7 and 8, as head bands, via supporting arms 5 and holders 6. The housing section 1 is supported by having its both ends gripped by both end portions of the substantially arcuate supporting arm 5. The housing section 2 is also supported by having its both ends gripped by both end portions of the substantially arcuate supporting arm 5. Each holder 6 is formed of a synthetic resin or the like and is mounted at the mid portion of each of these supporting arms 5. The connecting bridges 7 and 8 are mounted for extending across the holders 6, 6. The connector bridges 7 and 8 are formed of tough materials, such as metal or synthetic resin, and are in the form of rods bent in a substantially arcuate shape. Thus the housing sections 1, 2 are interconnected by the connector bridges 7 and 8. Thus the housing sections 1, 2 are supported with the speaker units facing towards each other.

Figure 2:
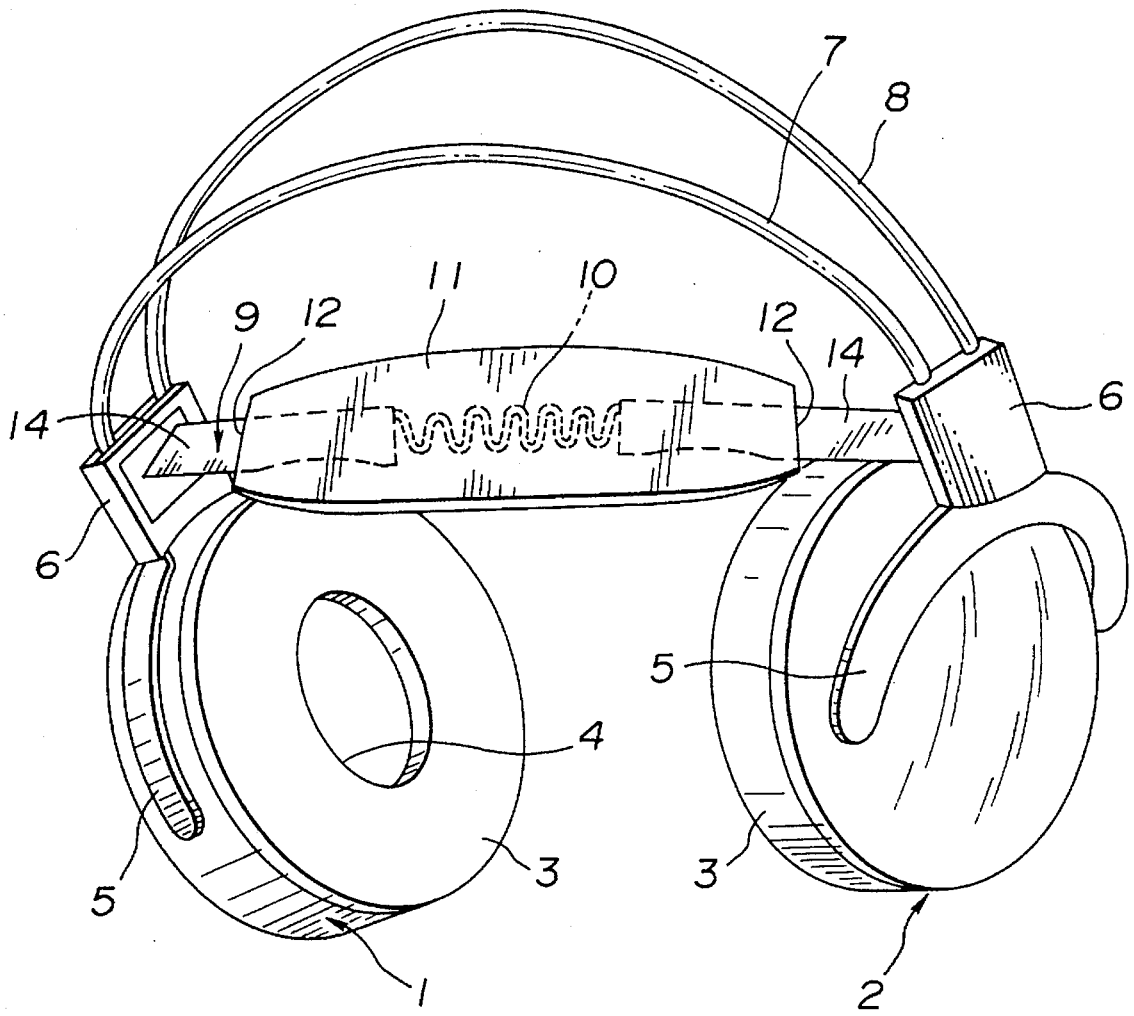
FIG. 2 is a perspective view showing the construction of the headphone apparatus according to a first embodiment of the present invention.
Figure 3:
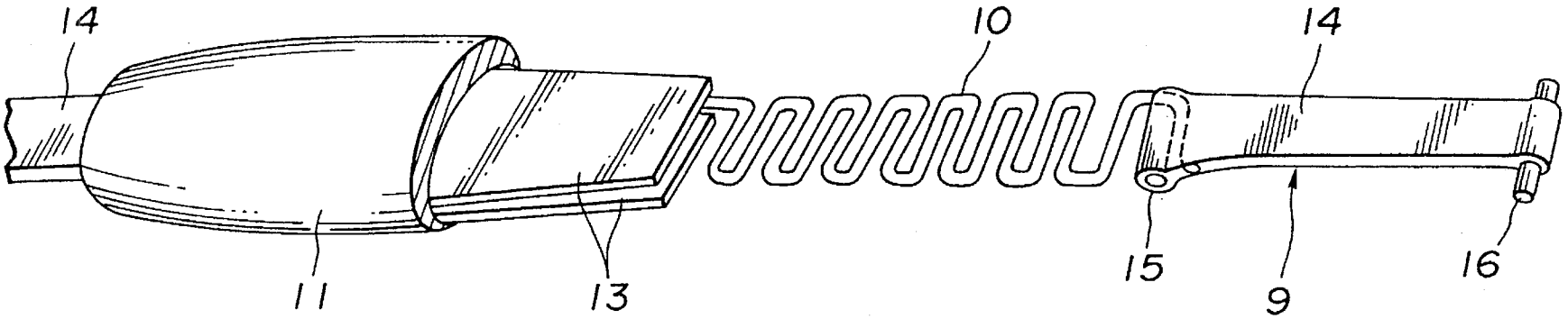
FIG. 3 is an enlarged perspective view showing a suspender member of the headphone apparatus shown in FIG. 1, a portion thereof being broken away.

The speaker units are fed with audio signals via cables, not shown. A suspender member 9 is mounted across the holders 6, 6. The suspender member 9 is made up of an extendable section 10 and a pair of non-extendable sections 14, 14 attached to both ends of and integral with the extendable section 10, as shown in FIGS. 2 and 3. The extendable section 10 includes a rod of spring metal bent in alternate directions into a cranked band. When the headphone apparatus is mounted on the user's head, the extendable section 10 is stretched by the user's head along the length of the suspender member 9 and is deformed to follow the shape of the head. The extendable section 10 is formed of a flexible material such as piano steel wire, stainless steel or Ti—Ni shape memory alloys. The non-extendable sections 14, 14 are formed of non-extendable materials, such as cloth, and are in the shape of bands. One ends of the non-extendable sections 14, 14 are formed as loops 15 for attachment to the ends of the extendable section 10. The opposite ends of the non-extendable sections 14, 14 are fitted with mounting pins 16, 16 as mounting means for the non-extendable sections 14, 14. The mounting pin 16 has a length longer than the width of the non-extendable section 14 and has its both ends protruded from both sides of the non-extendable sections 14.

Figure 4:
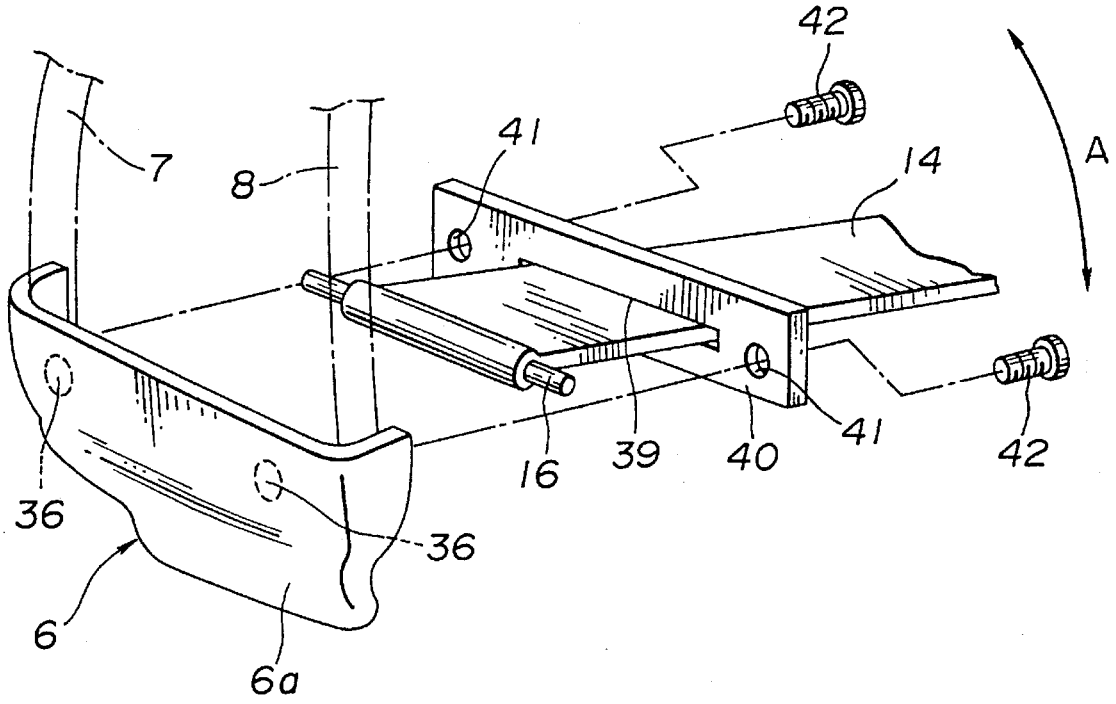
FIG. 4 is an enlarged schematic perspective view showing the mounting structure of the suspender member of the headphone apparatus shown in FIG. 1.

The suspender member 9 is supported between the holders 6, 6 by having the mounting pins 16, 16 retained by the holders 6, 6. The mounting pin 16 is mounted on the holder 6 by passing the non-extendable section 14 through an elongated opening 39 formed in an inner side plate 40 of the holder 6. That is, the holder 6 is made up of an outer side plate **6*a* and the inner side plate 40, between which the mounting pin 16 is located, with the non-extendable section 14 being passed through the opening 39. The elongated opening 39 is in the form of a slit having a length longer than the width of the non-extendable section 14 and shorter than the length of the mounting pin 16. The inner side plate 40 has a pair of tapped holes 41, 41. The inner side plate 40 is mounted on the outer side plate 6*a* by set screws 42, 42 introduced through the tapped holes 41, 41 so as to be engaged in tapped bosses 36, 36 formed on the inner lateral side of the outer side plate 6*a*. The non-extendable section 14 is supported for rotation with respect to the holder 6 about the axis of the mounting pin 16, as indicated by an arrow A in FIG. 4**.

The suspender member 9 has its mid portion inclusive of the extendable section 10 sheathed by a pad member 11. The pad member 11 is substantially tubular in shape and formed of a flexible material, such as synthetic leather. The suspender member 9 has its mid portion sheathed within the pad member 11 and has its end sections, that is the non-extendable sections 14, pulled out via both end openings of the pad member 11. Between the inner surface of the pad member 11 and the extendable section 10, lubricous sheets 13, 13 formed of a suitable synthetic material, such as polyethylene terephthalate (PET), are interposed for sandwiching the extendable section 10 in-between from upper and lower sides thereof. The lubricous sheets 13, 13 are arranged within the interior of the pad member 11 for clamping the extendable portion 10 from its both sides.

With the above-described construction of the headphone apparatus according to the present invention, the headphone apparatus is set on the user's head, with the speaker units of the housing sections 1 and 2 facing the user's pinnas. At this time, the suspender member 9 is interposed between the connector bridges 7 and 8 and the user's head, while the pad member 11 is positioned on the scalp. The suspender member 9 is thrust by the head to stretch the extendable section 10. Since the suspender member 9 thrusts the head in this manner, the housing sections 1, 2 are supported at the positions facing the pinnas. Consequently, with the present headphone apparatus, the variable distances between the scalp and the pinnas of the individual users can be accommodated without changing the relative position between the connector bridges 7, 8 and the housing sections 1, 2.

Figure 5:
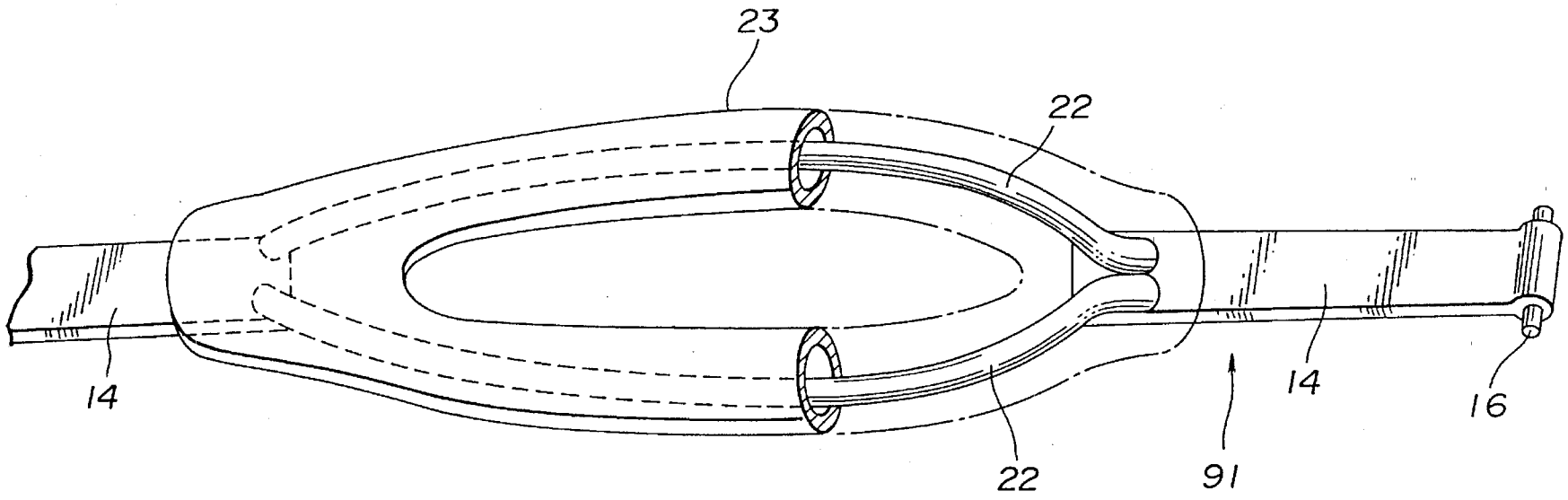
FIG. 5 is an enlarged perspective view of the suspender member of the headphone apparatus according to a second embodiment of the present invention, with a portion thereof being broken away.

Referring to FIG. 5, a headphone apparatus according to a second embodiment of the present invention is now explained. Since the headphone apparatus of the present second embodiment differs from the previous embodiment only in the structure of the suspender member, and the remaining construction is the same as that in the previous embodiment, only the suspender member is explained.

A suspender member 91 has an extendable section 22 formed of rubber, in place of the extendable section 10 of metal in the previous embodiment. Non-extendable sections 14, 14 are attached to both ends of the extendable section 22 formed of rubber. With the extendable section 22 formed of rubber, the extendable section 22 is bifurcated at a mid portion and composed of a pair of extendable sections 22, 22, as shown in FIG. 5. These extendable portions 22, 22 are sheathed by a tubular pad member 23 having a mid portion bifurcated and again unified together.

With the headphone apparatus of the present second embodiment, similarly to the headphone apparatus of the previous embodiment, the suspender member 91 has its extendable section 22 thrust by the user's head, when the headphone apparatus is attached to the user's head, so that the extendable portion 22 is extended lengthwise of the suspender member 91. Since the suspender member 91 thrusts the head under the resilient recoiling force of the extendable section 22, the housing sections 1, 2 are positioned facing the user's pinnas.

Figure 6:
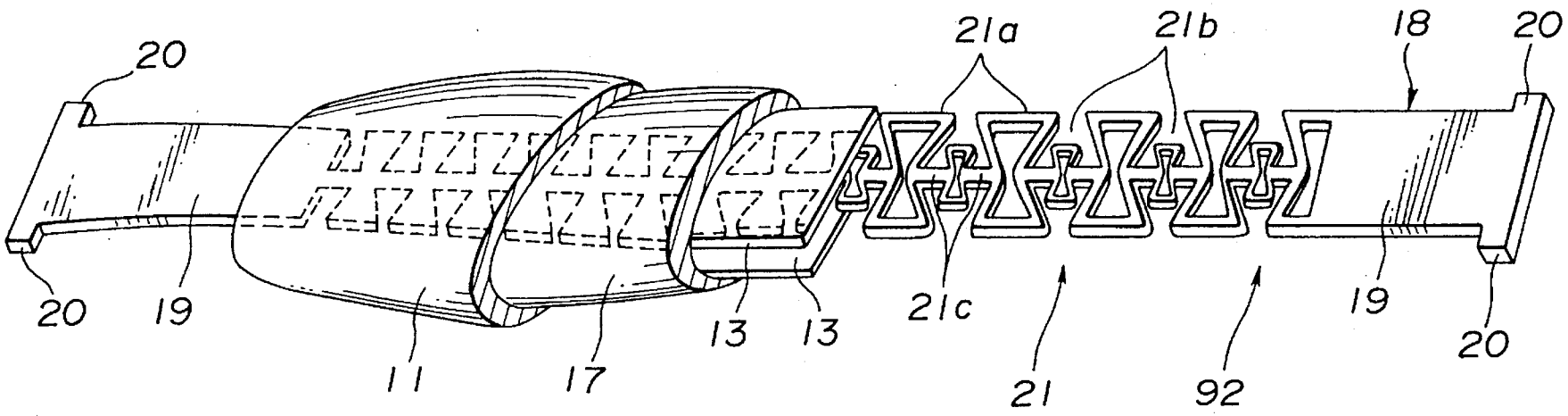
FIG. 6 is an enlarged perspective view of the suspender member of the headphone apparatus according to a third embodiment of the present invention, with a portion thereof being broken away.

Referring to FIG. 6, a headphone apparatus according to a third embodiment of the present invention is explained. Since the headphone apparatus of the present second embodiment again differs from the previous embodiment only in the structure of the suspender member, and the remaining construction is the same as that in the previous embodiment, only the suspender member is explained.

With the headphone apparatus of the third embodiment, the suspender member 92 is formed integrally of a synthetic material and composed of an extendable section 21 and a pair of non-extendable sections 19, 19 extended on both sides of the extendable section 21. The extendable section 21 is made up of a large number of large-sized and small-sized segments, each in the form of a figure eight, interconnected in the form of a band. Specifically, the extendable section 21 formed of a large number of large-sized eight-shaped segments and a large number of small-sized eight-shaped segments, interconnected by a straight line segment 21*c*. Each of the eight-shaped segments 21*a*, 21*b* is included a pair of straight sides facing each other with a gap in-between and substantially vee-shaped sides interconnecting the straight sides. The substantially vee-shaped sides are arranged with the apices facing each other. The eight-shaped segments making up the extendable section 21 are arrayed with the short sides lying parallel to the longitudinal direction of the extendable section 21. The non-extendable sections 19, 19 are formed as flat bands. Four retention lugs 20 are formed on both sides of the suspender member 92. These retention lugs are adapted to be retained by mating inner side parts of the holders 6, 6.

The suspender member 92 shown in FIG. 6 is preferably formed of a synthetic material, such as a thermoplastic polyester elastomer. Such thermoplastic polyester elastomer may be exemplified by, for example, that manufactured by TORAY DuPONT Inc. under the trade name of "Hytrel". The thermoplastic polyester elastomer, such as Hytrel, has a PBT based composition and is superior in heat resistance and resistance against chemicals, such that it is less likely to be attacked by chemicals, such as hair conditioner attached to the user's hair. In addition, such a material exhibits superior creep characteristics against repeated extension and contraction of bending.

The suspender member 92 shown in FIG. 6 has its center portion sheathed by a pad member 11. A pair of lubricous sheets 13, 13 and a buffer member 17 are interposed between the pad member 11 and the suspender member 92. The lubricous sheets 13, 13 are arranged for clamping the extendable portion 21 from its both sides. The buffer member 17 is formed as a cylinder of a synthetic material, such as urethane, and is interposed between the lubricous sheets 13, 13 and the pad member 11 for sheathing the lubricous sheets 13, 13.

Figure 7:
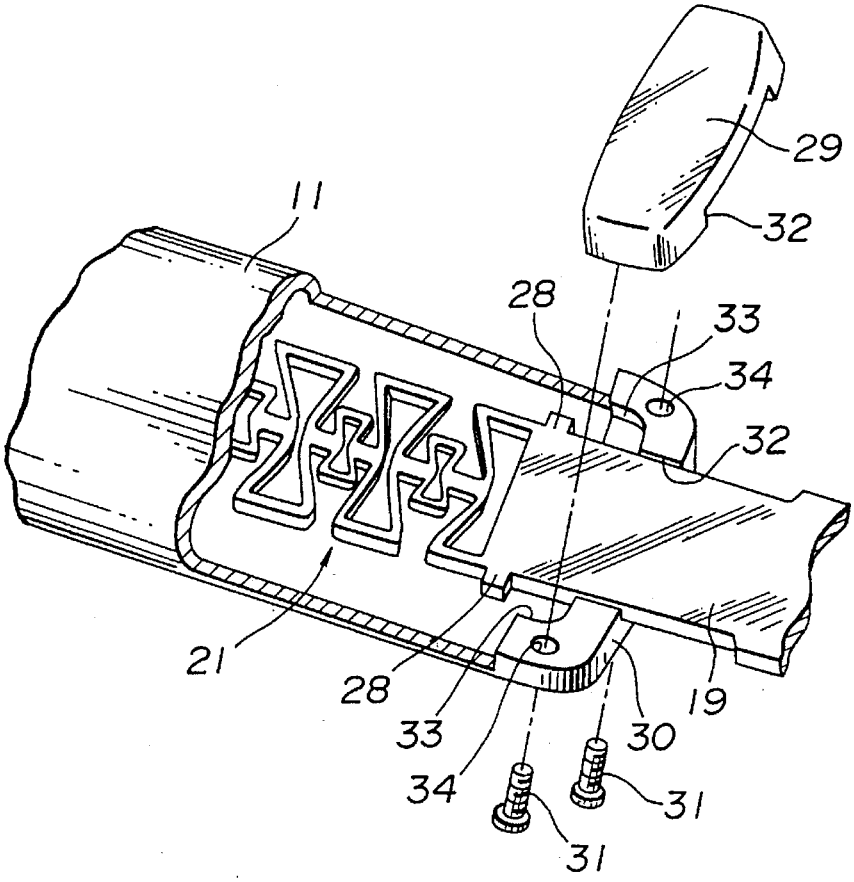
FIG. 7 is an enlarged perspective view of the suspender member shown in FIG. 6, with a portion thereof being broken away.

If the suspender member 92 comprising the extendable section 21 and the non-extendable sections 19, 19 is used, the pad member 11 is provided on both sides thereof with a stop member as shown in FIG. 7. The stop member is formed by an upper plate section 29 and a lower plate section 30 abutted and connected to each other, and is mounted to both ends of the pad member 11. The upper plate section 29 and the lower plate section 30 are connected to each other with set screws 31, 31. The stop member has a through-hole 32 for the non-extendable portion 19 to pass therethrough and stop shoulders 33, 33 in the inner surface thereof in the vicinity of the through-hole 32. The non-extendable sections 19, 19 are formed with retention lugs 28, 28 adjacent to both sides of the extendable section 21. These retention lugs 28, 28 are formed more inwardly of the pad member 11 than the stop member. When the extendable section 21 is extended, the retention lugs 28, 28 are caused to bear against the stop shoulders 33, 33 in order to prevent the extendable section 21 from being pulled out of the pad member 11.

With the headphone apparatus of the present third embodiment, similarly to the headphone apparatus of the previous embodiment, the suspender member 91 has its extendable section 22 thrust by the user's head, when the headphone apparatus is attached to the user's head, so that the extendable section 22 is extended lengthwise of the suspender member 91. The substantially vee-shaped sides of the eight-shaped segments 21*a*, 21*b* are elastically displaced longitudinally of the suspender member 92 for enlarging the opening areas of the eight-shaped segments. As a result, the extendable section 21 may be extended along the length of the suspender member 92. Since the suspender member 92 thrusts the head under the elastic recoiling force of the extendable section 21, the housing sections 1, 2 may be positioned facing the user's pinnas.

Figure 8:
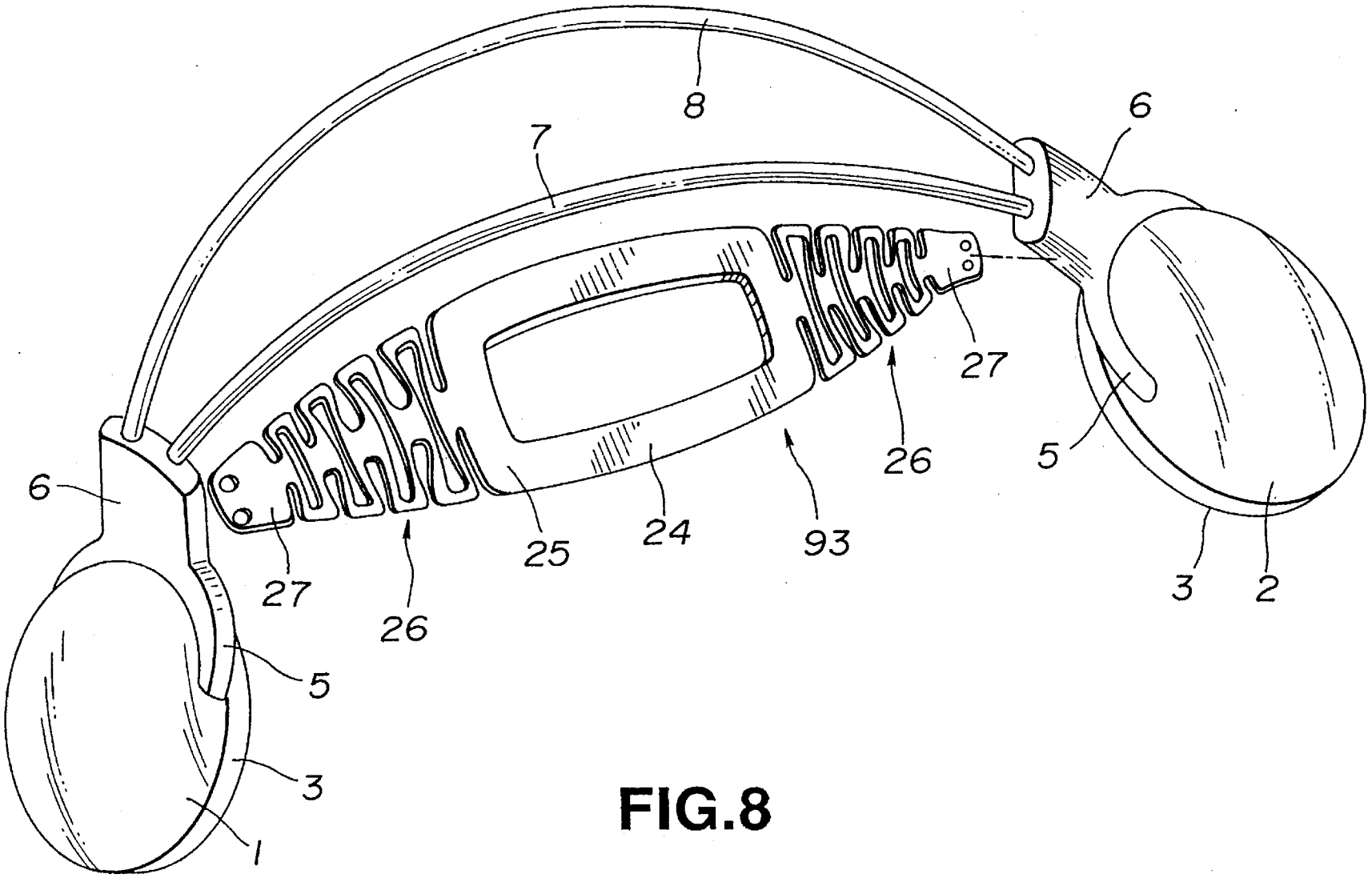
FIG. 8 is an exploded perspective view showing the construction of the headphone apparatus according to a fourth embodiment of the present invention.

Referring to FIG. 8, a headphone apparatus according to a fourth embodiment of the present invention is explained. In the present embodiment, parts or components similar to those of the first embodiment are correspondingly numbered and only those parts or components different from the first embodiment are explained.

If the suspender member 93 is formed integrally of a synthetic material, it has its central portion and both end portions composed of non-extendable sections 24, 27, 27, as shown in FIG. 8. The non-extendable sections 24, 27 and 27 are interconnected by extendable sections 26, 26. With the suspender 93, shown in FIG. 8, the central non-extendable section 24 is used as a head pad abutted against the user's head. Consequently, the suspender member 93 is not sheathed by the pad member 11, in contradistinction from the previous embodiment. The non-extendable sections 27, 27 on both end sections of the suspender member 93 are mounted facing the holders 6, 6. Similarly to the extendable section 21 of the previous embodiment, each of the extendable sections 26 is composed of a number of eight-shaped segments. The preferred material for the suspender member 93 shown in FIG. 8 is again the above-mentioned thermoplastic polyester elastomer.

Figure 9:
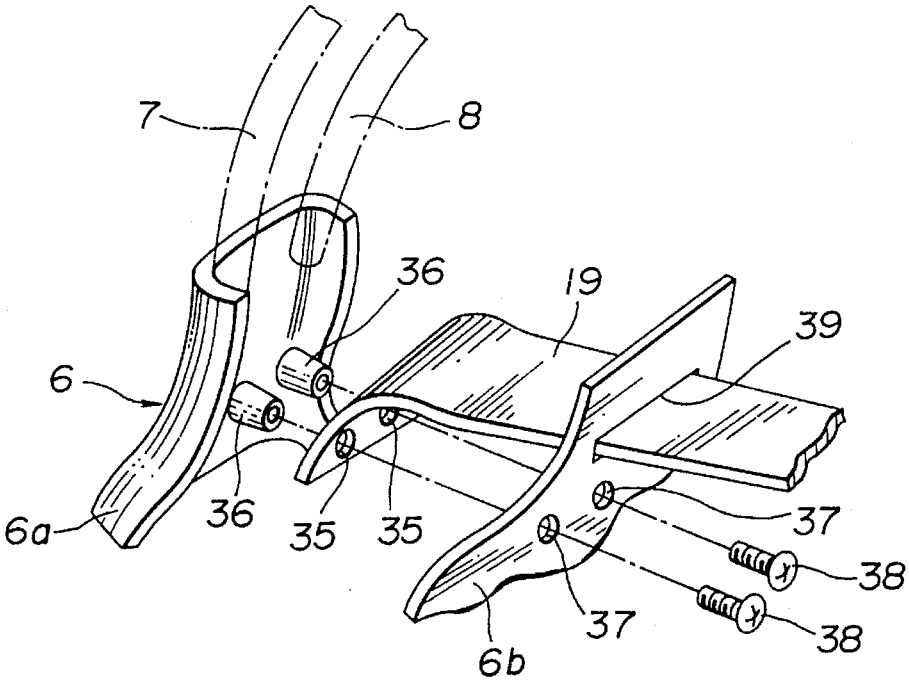
FIG. 9 is an enlarged schematic perspective view showing the mounting structure of a suspender member of the headphone apparatus shown in FIG. 8.

With the use of the suspender member 93, formed integrally of the synthetic material, the suspender member 93 is mounted at both ends thereof to the holders 6, 6 by co-tightening of set screws 38, 38 employed for coupling the outer side plate 6*a* and the inner side plate 6*b* making up the holder 6, as shown in FIG. 9. To this end, tapped holes 35, 35 are formed in the vicinity of the foremost parts of the non-extendable sections 19, 27. The non-extendable sections 24, 27 are introduced into a space between the outer side plate 6*a* and the inner side plate 6*b* via the slit-shaped through-opening 39 formed in the inner side plate 6*b*. The set screws 38, 38 are inserted from outside into the tapped holes 37, 37 in the inner side plate 6*b* and into the tapped holes 35, 35 in he non-extendable sections 19, 27 and further into the tapped holes in the tapped bosses 36, 36 formed on the inner lateral sides of the outer side plate 6*a*. The non-extendable portions 19, 19, 27, 27 may be mounted in this manner on the holders 6, 6.

With the headphone apparatus of the present fourth embodiment, similarly to the headphone apparatus of the previous embodiment, the suspender member 93 is thrust by the user's head, when the headphone apparatus is attached to the user's head, so that the extendable sections 26, 26 are extended lengthwise of the suspender member 93. The extendable sections 26, 26 are elastically displaced longitudinally of the suspender member 93, in a direction of enlarging the gap of the eight-shaped segments, as in the third embodiment. The suspender member 93 thrusts the head under the elastic recoiling force of the extendable sections 26, 26, so that the housing sections 1, 2 are positioned facing the pinnas.

The present invention is not limited to the above-described embodiments, but may comprise a latitude of modifications. For example, the extendable sections of the belt-shaped member may be formed of synthetic material in a shape including plural toroidal sections connected to one another as shown in FIG. 6, while the non-extendable section may be formed of a substantially inextendable material soft to the skin, such as cloth.

What is claimed is:

1. A headphone apparatus comprising:

a head band formed in a bent shape;

a headphone unit provided on each side of said head band;

a suspender member mounted between the two sides of the head band to respective positions above a location of attachment of the head band to said headphone unit on each side, said suspender member being entirely between said head band and said headphone unit deformed along the contour of the head when the headphone apparatus is mounted on the head, said suspender member having non-extendable sections and an extendable section unified to said non-extendable sections and extended and contracted along the length of said suspender member;

a pad member mounted on said suspender member for sheathing said extendable section; and a pair of lubricous sheets arranged between the suspender member and said pad member for clamping said suspender member in-between and with a buffer member arranged between each of said lubricous sheets and said pad member.

2. A headphone apparatus according to claim 1, wherein said suspender member is made up of the extendable section and the non-extendable sections integrally formed of synthetic resin.

3. A headphone apparatus according to claim 2, wherein said extendable section is of a spring structure.

4. A headphone apparatus according to claim 3, wherein said extendable section is of a corrugated spring structure.

5. A headphone apparatus according to claim 3, wherein said suspender member is made up of plural deflectable segments and connecting segments interconnecting said deflectable segments, each of said deflectable segments having a gap at a mid portion, first and second sides parallel to and facing each other and substantially vee-shaped third and fourth sides, with the apices of the vee-shape pointing to each other, said connecting segments interconnecting recessed portions of the vee-shaped third and fourth sides.

6. A headphone apparatus according to claim 1, wherein said extendable section is constituted by plural deflectable segments deflectable along the length of the suspender member.

7. A headphone apparatus according to claim 1, wherein said suspender member is constituted by said extendable section and the non-extendable section on both sides of said extendable section.

8. A headphone apparatus according to claim 1, wherein said suspender member is constituted by said non-extendable sections and the extendable section, wherein said non-extendable sections are constituted by a first centrally disposed first non-extendable section and second and third non-extendable sections for attachment to said head band and wherein said extendable section is constituted by a first extendable section arranged between the first non-extendable section and the second non-extendable section and a second extendable section arranged between the first non-extendable section and the third non-extendable section.

9. A headphone apparatus according to claim 1, wherein said extendable section is constituted by an elastic member.

10. A headphone apparatus comprising:

a head band formed in a bent shape of a material exhibiting pre-set tenacity;

a pair of supports provided at both ends of said head band;

a pair of headphone units mounted at free ends of said supports; and a suspender member mounted across both ends of the head band at a position above a location of attachment of the head band to said headphone unit, said suspender member having its both ends mounted at the proximal ends of each of the supports and being located entirely between said head band and said headphone units, said suspender member being deformed along the contour of the head when the headphone apparatus is mounted on the head, said suspender member having a non-extendable section and an extendable section unified to said non-extendable section, said extendable section being extended and contracted along the length of said suspender member;

wherein said head band is further provided with a pad member provided in said suspender member for sheathing said extendable section; and wherein said head band also includes a pair of lubricous sheets provided between the suspender member and the pad member for clamping the suspender member in-between and a buffer member arranged between the lubricous sheets and said pad member.

11. A headphone apparatus according to claim 10, wherein said suspender member is made up of the extendable portion and the non-extendable portions integrally formed of synthetic resin.

12. A headphone apparatus according to claim 11, wherein said extendable section is constituted by plural deflectable portions deflectable along the length of said belt-shaped member and a connection portion interconnecting said deflectable portions.

13. A headphone apparatus according to claim 11, wherein said non-extendable sections are arranged on both sides of the extendable section.

14. A headphone apparatus according to claim 12, wherein said extendable section is constituted by an elastic member.

* * * * *